United States Patent [19]

Schurz

[11] Patent Number: 4,774,031

[45] Date of Patent: Sep. 27, 1988

[54] AERATOR

[75] Inventor: James L. Schurz, New Hope, Minn.

[73] Assignee: Aeration Industries, Inc., Chaska, Minn.

[21] Appl. No.: 40,717

[22] Filed: Apr. 21, 1987

Related U.S. Application Data

[63] Continuation of Ser. No. 637,044, filed as PCT US83/01647 on Nov. 24, 1983, published WO85/01887 on May 9, 1985, abandoned.

[51] Int. Cl.[4] ..... B01F 3/04

[52] U.S. Cl. ..... 261/87; 210/219; 210/220; 261/DIG. 75; 366/102; 416/204 R; 416/223 R

[58] Field of Search ..... 261/24, 87, 93, 120, 261/91, DIG. 75; 210/219, 220; 209/169, 170; 366/102, 147; 415/8, 102, 210; 417/367, 424; 416/237, 223 R, 204 R, 244 B; 384/397

[56] References Cited

U.S. PATENT DOCUMENTS

| | | | |
|---|---|---|---|
| 2,410,429 | 11/1946 | Daman | 261/87 |
| 2,966,345 | 12/1960 | Burgoon et al. | 261/87 |
| 3,778,233 | 12/1973 | Blough et al. | 261/93 X |
| 3,920,779 | 11/1975 | Abele | 261/87 |
| 3,975,469 | 8/1976 | Fuchs | 261/87 |
| 4,240,990 | 12/1980 | Inhofer et al. | 261/87 |
| 4,280,911 | 7/1981 | Durda et al. | 261/87 X |
| 4,293,169 | 10/1981 | Inhofer | 384/397 |
| 4,308,221 | 12/1981 | Durda | 209/169 X |
| 4,409,100 | 10/1983 | Rajendren | 261/93 X |

OTHER PUBLICATIONS

O'Brien, T. P.; *The Design of Marine Screw Propellers;* pp. 25–33, 291, 292; Hutchinson and Co.; 1962.

*Primary Examiner*—Richard L. Chiesa
*Attorney, Agent, or Firm*—Banner, Birch, McKie & Beckett

[57] ABSTRACT

An aerator (10) is disclosed which includes a hollow outer tube (12) and a hollow inner tube (14) rotatably supported therein. The inner tube is drivingly connected to a drive shaft (28) of the motor (18). A mounting flange (34) extends from a first end (36) of the outer tube and a mounting bracket (30) is interposed between the mounting flange and the motor. The mounting bracket and mounting flange are removably attached to the motor. A bearing mechanism which includes a bearing (44) and a ceramic wear sleeve (46) rotatably support a second end (40) of the inner tube adjacent the second end (42) of the outer tube. A propeller (20) is attached to the second end of the inner tube and has a pitch which is sufficiently high to move liquid past it at a velocity wherein cavitation of the liquid above the propeller is prevented at a preselected operating rotational speed.

5 Claims, 1 Drawing Sheet

AERATOR

This application is a continuation of application Ser. No. 637,044, filed as PCT US83/01647 on Nov. 24, 1983, published WO85/01887 on May 9, 1985, now abandoned.

BACKGROUND OF THE INVENTION

The present invention relates broadly to apparatus for mixing a gas with a liquid, i.e., an aerator. More particularly, the present invention relates to an apparatus for aerating water in a water treatment process, and is an improvement of the apparatus discussed in U.S. Pat. No. 4,240,990, issued to Harold J. Inhofer et al. on Dec. 23, 1980, and U.S. Pat. No. 4,308,221, issued to Daniel J. Durda on Dec. 29, 1981, the disclosures of which are hereby incorporated by reference.

Aeration apparatus are utilized in the treatment of water for the purpose of increasing the dissolved oxygen (DO) content of the water. A certain amount of dissolved oxygen is required for the life of fish and other aquatic organisms. Dissolved oxygen is also required to prevent formation of offensive odors and to break down organic matter in water. The biochemical oxygen demand (BOD) is the measure of the amount of oxygen consumed in the biological processes which break down organic matter in water. A high BOD indicates that large amounts of organic waste are present and will use up large amounts of dissolved oxygen. Aeration apparatus are especially useful in increasing the amount of dissolved oxygen and, hence, are useful in high-BOD situation.

Aerators utilized in waste water treatment can be broadly classified into two types; a diffused air type, and a mechanical type. A diffused air type aerator introduces air or pure oxygen into water via submerged porous diffusers or nozzles. Mechanical type aerators agitate the water so as to promote solution of air from the atmosphere.

Mechanical type aerators are further classified as either surface aerators or turbine aerators. A surface aerator utilizes a submerged or partially submerged impeller which agitates the water vigorously to thereby entrain air in the water and cause a rapid change in the air-water interface. Turbine aerators generally utilize a rotating impeller which is disposed a certain distance below the surface of the water being treated. A draft tube is supported generally coaxial with the axis of rotation of the impeller and is utilized to supply air to the liquid adjacent the impeller.

SUMMARY OF THE INVENTION

The present invention is directed to an apparatus for mixing a gas and a liquid, such as water. The apparatus is comprised of a hollow outer tube and a hollow inner tube received coaxially within the outer tube. The inner tube is mounted for rotatary motion within the hollow interior of the outer tube. A motor is attached to the outer tube adjacent a first end thereof and is drivingly coupled to a first end of the inner tube. The inner tube has a section which extends beyond the second end of the outer tube. A propeller is attached to this section of the inner tube for rotation therewith. The propeller is adapted to be placed in a liquid and to propel the liquid in which the propeller rotates. An inlet is formed in the inner tube for admitting a gas to the hollow interior of the inner tube. A means for preventing the formation of a vortex above the propeller is provided. The prevention means includes forming the propeller with a pitch sufficiently high so that the liquid is propelled in the area surrounding the propeller at a velocity which prevents cavitation from occurring directly above the propeller at a predetermined operating rotational speed.

In a preferred embodiment, a mounting flange extends from the first end of the outer tube and a mounting bracket is interposed between the motor and the mounting flange. The mounting bracket and mounting flange are removably attached to the motor. A bearing mechanism for rotatably supporting the inner tube adjacent its second end is provided. The bearing mechanism includes a bearing supported in the hollow interior of the outer tube and a ceramic wear sleeve disposed between the bearing and the outer surface of the inner tube.

In prior aerators of this type, wherein relatively low pitch propellers were used, a vortex tended to form above the propeller when the propeller was driven at its operating speed or at the maximum operating speed of the driving motor. To prevent the formation of the vortex, prior aerators utilized a shield disposed above and around the propeller. In accordance with the present invention, the need for such a shield is eliminated since the high pitch propeller causes the liquid surrounding it to move at a sufficiently high velocity to prevent cavitation from occurring directly above the propeller at a predetermined operating rotational speed. Thus, once a operational speed for an aerator is selected, a pitch sufficiently high to accomplish this purpose is selected. For example, an eight-inch pitch propeller has been found suitable for a 5 horsepower motor operating on 60 or 50 cycle current and driving at 3,400 to 3,600 rpm and 2,800 to 3,000 rpm, respectively; while for a 2 horsepower motor a 6-inch pitch propeller has been found suitable when the motor operates on 60 cycle current at 3,400 to 3,600 rpm, while an 8-inch pitch propeller is preferred when the motor operates on 50 cycle current at 2,800 to 3,000 rpm.

Serviceability of the aerator is enhanced by using a separate mounting bracket and a separate outer tube with a mounting flange, both of which are removably attached to the motor. Aerators of this type are frequently located on floats in large bodies of water and at a distance spaced from a shore line. Access to such aerators is by boat. Thus, by forming the outer housing separate from the mounting bracket and motor, the inner and outer tubes and propeller can be removed from the motor for servicing and returned to the shore, while the motor and its wiring can remain on the float. Also, the motor can be readily run independent of the inner tube for test purposes.

Aerators of this type are frequently used to aerate water in a waste water environment. Such liquid environment contains quantities of sedimentary solids, and, when the mixing action is induced, the sediments are dispersed throughout the liquid and are introduced at the bearing. Typically, the bearing is formed of a rubber or rubber-like material such as Teflon and a wear sleeve is interposed between the inner surface of the bearing and the outer surface of the rotating tube. Typically, the wear sleeve has been formed of a metallic substance. Fine particles frequently embed themselves within the bearing and cause wear and deterioration of the wear sleeve. Metallic wear sleeves have exhibited relatively short useful lives. The use of a ceramic wear sleeve in accordance with the present invention significantly extends the useful life of the wear sleeve.

Various advantages and features of novelty which characterize the invention are pointed out with particularity in the claims annexed hereto and forming a part hereof. However, for a better understanding of the invention, its advantages, and objects obtained by its use, reference should be made to the drawings which form a further part hereof, and to the accompanying descriptive matter, in which there is illustrated and described a preferred embodiment of the invention.

DETAILED DESCRIPTION OF THE INVENTION

Figures 1, 2:
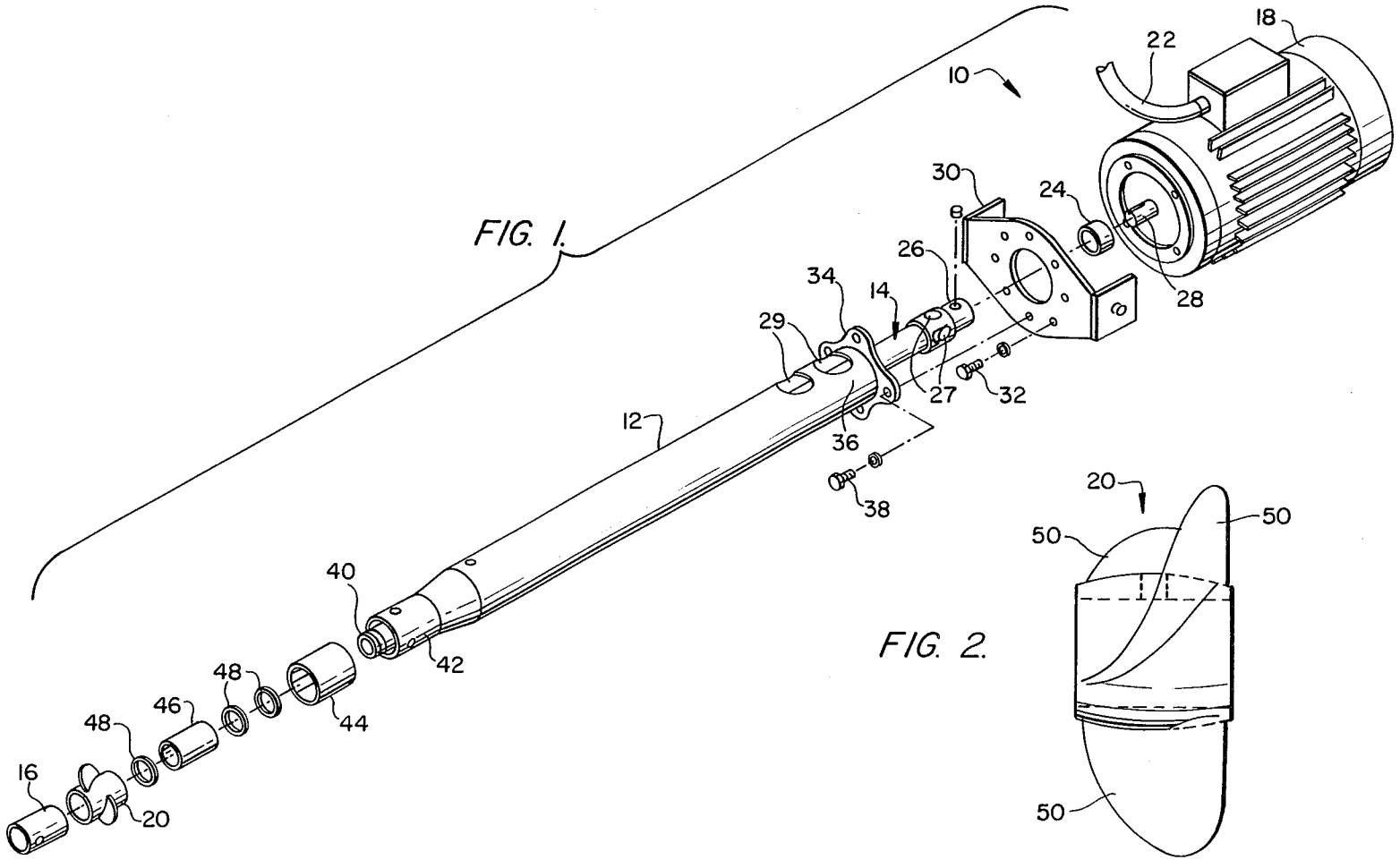
FIG. 1 is an exploded perspective view of an aerator in accordance with the present invention.
FIG. 2 is a side view of a propeller for use in an aerator in accordance with the present invention.

Referring to the drawings in detail, wherein like numerals indicate like elements, there is shown in FIG. 1 an aerator apparatus in accordance with the present invention designated generally as 10. Apparatus 10 is adapted for use as an aerator for mixing a gas, generally ambient air, in a liquid. A detailed description of a typical use of an aerator in accordance with the present invention is found in U.S. Pat. No. 4,308,221. Apparatus 10 includes an outer housing 12 in the form of an elongated tube, an inner tube 14 including a diffuser section 16, a motor 18, and a propeller 20.

Motor 18 is preferably an electric motor which is connected to an electrical power source through a cord 22. A spacer 24 is interposed between a first upper end 26 of inner tube 14 and motor 18, and first end 26 of tube 14 is removably connected to a drive shaft 28 of motor 18. A mounting bracket 30 is removably connected to motor 18 by screws 32, one of which is shown in FIG. 1. A mounting flange 34 extends from an upper first end 36 of outer tube 12 and is removably attached to motor 18 by screws 38, one of which is shown in FIG. 1. Inner and outer tubes 14, 12 and mounting bracket 30 are thus removably attached to motor 18. Air inlet holes 27 are formed in inner tube 14 adjacent its first end 26, and air inlet holes 29 are formed in outer tube 12 adjacent its first end 36.

A lower second end 40 of inner tube 14 is rotatably supported at a second lower end 42 of outer tube 12 by a bearing 44. Bearing 44 is held within the hollow interior of tube 12 at the second end 42 and can be a typical conventional water bearing having an inner rubber or rubber-like bearing surface. A ceramic wear sleeve 46 is placed between the outer surface of inner tube 14 and the inner surface of bearing 44. Washers 48 can be placed about bearing 44 and wear sleeve 46. Propeller 20 is placed on the outer surface of second end 40 of inner tube 14, and diffuser section 16 is attached to second end 40 to hold propeller 20 on the inner tube. The hollow interior of propeller 20 and the hollow interior of diffuser section 16 form a continuation of the hollow interior of inner tube 14. When propeller 20 is driven within the liquid, liquid is driven by the propeller and air is aspirated through inner tube 14 and ejected out of diffuser section 16.

Blades 50 of propeller 20 preferably have tapered non-fouling leading edges so that debris in the liquid being treated does not become entangled with the propeller. The pitch of blades 50, and thus of propeller 20, are such that at a predetermined operating rotational speed liquid is driven by the propeller at a velocity which is sufficient to prevent the formation of a vortex above propeller 20. Blades 50 also preferably have either a varying rake, that changes to a more positive rake from the leading end to the tailing end of the blades, or a positive rake, as disclosed in U.S. Pat. No. 4,240,990. The propeller thus moves the liquid in a relatively narrow stream and at a velocity sufficient to prevent cavitation, thus eliminating the need of a vortex prevention shield. In normal operation, when a horizontal flow of the liquid is desired, the aerator is disposed in the liquid at an acute angle relative to the horizontal, for example, between 20° and 60° below horizontal.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and the arrangement of parts, within the principle of the invention, to the full extent intended by the broad general meaning of the terms in which the appended claims are expressed.

I claim:

1. An apparatus for mixing a gas and a liquid comprising:

an outer housing have a hollow interior, opposite first and second ends, and a longitudinal dimension extending between said two ends;

inner tube means for defining an air passage;

said inner tube means being mounted for rotary motion about its axis within the hollow interior of said outer housing;

motor means drivingly and removably coupled to a first end of said inner tube means for rotating said inner tube means;

a second end of said inner tube means being open and having a section extending beyond the second end of said outer housing;

an open unobstructed propeller attached to said section of said inner tube means for rotation therewith, said propeller being adapted to be placed in a liquid and to propel the liquid through which the propeller rotates;

inlet means for admitting a gas into said inner tube means, and said second end of said inner tube means being below said propeller whereby the liquid propelled by said propeller passes said second end of said inner tube means to aspirate gas therethrough; and means for preventing without any vortex shield the formation of a vortex above said propeller in liquid being propelled by said propeller, when said inner tube means is disposed at an acute angle relative to the horizontal, said prevention means only including said propeller having a pitch sufficiently high to propel the liquid in the areas surrounding the propeller at a velocity which prevents vortices from occurring directly above the propeller at a predetermined operating rotational speed and thereby eliminating the use of said any vortex shield.

2. An apparatus for mixing a gas and a liquid comprising:

an outer housing having a hollow interior, opposite first and second ends, a longitudinal dimension extending between the two ends, and a mounting flange extending radially at said first end and having a plurality of holes formed therethrough;

inner tube means for defining an air passage;

said inner tube means being mounted for rotary motion about its axis within the hollow interior of said outer housing;

motor means drivingly and removably coupled to a first end of said inner tube means for rotating said inner tubes means, said motor means having a plurality of holes formed in its face;

a mounting bracket interposed between said motor means and said mounting flange and having a plurality of holes formed therethrough;

means for removably attaching said mounting flange to said mounting bracket including a plurality of first fasteners passing through aligned ones of said mounting flange holes and said mounting bracket holes, and means for removably attaching said motor means to said mounting bracket including a plurality of second fasteners passing through aligned ones of said mounting bracket holes and said motor means holes, whereby said outer housing and inner tube means can be removed from said apparatus separate from said motor means;

a second end of said inner tube means being open and having a section extending beyond the second end of said outer housing;

a propeller attached to said section of said inner tube means for rotation therewith, said propeller being adapted to be placed in a liquid and to propel the liquid through which the propeller rotates; and inlet means for admitting a gas into said inner tube means, and said second end of said inner tube means being below said propeller whereby the liquid propelled by said propeller passes said second end of said inner tube means to aspirate gas therethrough.

3. An apparatus in accordance with claim 2 including bearing means for rotatably supporting said inner tube means adjacent its second end, said bearing means including a bearing supported in the hollow interior of said outer housing and a ceramic wear sleeve disposed between said bearing and an outer surface of said inner tube means.

4. An apparatus as set forth in claim 2 further comprising means for preventing the formation of a vortex above said propeller in liquid being propelled by said propeller, when said inner tube means is disposed at an acute angle relative to the horizontal, said prevention means including said propeller having a pitch sufficiently high to propel the liquid in the areas surrounding the propeller at a velocity which prevents vortices from occurring directly above the propeller at a predetermined operating rotational speed.

5. An apparatus in accordance with claim 2 wherein said mounting flange holes are aligned with a first set of said mounting bracket holes, and said motor means holes are aligned with a second separate set of said mounting bracket holes.

* * * * *